US008074846B2

(12) United States Patent
Allegaert

(10) Patent No.: US 8,074,846 B2
(45) Date of Patent: Dec. 13, 2011

(54) DISPENSER OR VIAL PUMP AND A TUBE AND VALVE ASSEMBLY USED IN SUCH

(75) Inventor: Rudi Jozef Allegaert, Aalst (BE)

(73) Assignee: Tekni-Plex, Inc., King of Prussia, PA (US)

( * ) Notice: Subject to any disclaimer, the term of this patent is extended or adjusted under 35 U.S.C. 154(b) by 929 days.

(21) Appl. No.: 11/659,963

(22) PCT Filed: Aug. 11, 2004

(86) PCT No.: PCT/BE2004/000115

§ 371 (c)(1),
(2), (4) Date: Feb. 12, 2007

(87) PCT Pub. No.: WO2006/015458

PCT Pub. Date: Feb. 16, 2006

(65) Prior Publication Data

US 2008/0083791 A1 Apr. 10, 2008

(51) Int. Cl.
*B67D 7/58* (2010.01)

(52) U.S. Cl. ..... 222/382; 222/321.7; 222/321.9; 222/402.1; 222/464.1

(58) Field of Classification Search ..... 222/464.1, 222/464.2, 402.1, 394, 402.2, 321.7, 382, 222/321.9; 138/177–178, 109
See application file for complete search history.

(56) References Cited

U.S. PATENT DOCUMENTS 2,311,845 A * 2/1943 Lindsay ..... 169/72
2,315,263 A * 3/1943 Lindsay ..... 169/72
2,610,091 A * 9/1952 Deutsch ..... 222/325
2,899,108 A * 8/1959 Knapp ..... 222/151
3,159,318 A * 12/1964 Green ..... 222/402.18
3,223,293 A * 12/1965 Seaquist ..... 222/402.24
3,231,153 A * 1/1966 Green et al. ..... 222/402.24
RE26,012 E * 5/1966 Green ..... 222/402.18
3,260,421 A * 7/1966 Rabussier ..... 222/402.18
3,301,438 A * 1/1967 Tillotson ..... 222/41
3,311,274 A * 3/1967 Green ..... 222/402.18
4,821,923 A * 4/1989 Skorka ..... 222/80
4,854,388 A * 8/1989 Wyatt ..... 169/26
5,165,575 A * 11/1992 Scott ..... 222/129.1
5,261,565 A * 11/1993 Drobish et al. ..... 222/95
5,273,189 A 12/1993 Jouillat et al.
5,277,015 A * 1/1994 Brown et al. ..... 53/449
5,347,956 A * 9/1994 Hughes ..... 122/14.3
5,385,303 A * 1/1995 Gosselin et al. ..... 239/394
5,495,965 A * 3/1996 Knickerbocker ..... 222/464.1
5,503,306 A * 4/1996 Knickerbocker ..... 222/321.1

(Continued)

FOREIGN PATENT DOCUMENTS

EP 0701951 A1 3/1996

(Continued)

*Primary Examiner* — Frederick C. Nicolas

(74) *Attorney, Agent, or Firm* — Rissman Hendricks & Oliverio, LLP

(57) ABSTRACT

Dispenser or vial pump, including a valve assembly (3) and a tube (4) that is fixed with one extremity to a nipple (6) of the valve assembly (3). The nipple (6) and tube (4) are in contact with each other with their respective contact surfaces (7, 8), at least one of the contact surfaces (7, 8) is provided with a roughness (9) in order to decrease the friction between the nipple (6) and the tube (4) during assembly.

11 Claims, 3 Drawing Sheets

U.S. PATENT DOCUMENTS 5,518,151 A * 5/1996 Knickerbocker ..... 222/382
5,522,548 A * 6/1996 Gallien et al. ..... 239/337
5,746,350 A 5/1998 Nishigami et al.
5,897,032 A * 4/1999 Ellion et al. ..... 222/189.1
6,016,934 A * 1/2000 Moriguchi ..... 222/1

FOREIGN PATENT DOCUMENTS

JP 2001219954 A * 8/2001

* cited by examiner

DISPENSER OR VIAL PUMP AND A TUBE AND VALVE ASSEMBLY USED IN SUCH

BACKGROUND

A. Field

The present invention relates to a dispenser or vial pump.

B. Related Art More specifically the present invention relates to dispensers or vial pumps as used to dispense or distribute a liquid or gaseous product.

It is generally known that such dispensers or vial pumps mainly consist of a valve assembly which is fixed on top of a container filled with said product to be distributed and of a tube which is fixed with one extremity to a nipple of said valve assembly and which extends with its other extremity towards the bottom of said container.

An important requirement for the dispenser or vial pump is to provide a strong retention force of the tube on the nipple, as otherwise, the tube may detach from the nipple, rendering the dispenser or vial pump inoperative.

Another important requirement for the dispenser or vial pump is that the connection between said nipple and said tube is impermeable to the product in said container, since any leakage involves a loss of efficiency of the concerning dispenser or vial pump.

In order to meet the above mentioned requirements, it is generally known to slide the tube over or in said nipple, whereby both the nipple and the tube have a round and smooth contact surface, allowing a tight friction fit between both elements.

An inconvenience of such known dispensers or vial pumps is that they are quite difficult to assemble, especially when both the nipple and the tube are made of materials having a relative high mutual surface friction, such as high density polyethylene (HDPE) or polypropylene (PP).

Indeed, when in this case the tube is slid over or in the nipple at high speed, for example at a rate of 600 assemblies a minute, the tube is likely to upset, resulting in an incomplete assembly or in an assembly with a poor retention force between the nipple and the tube, which is unacceptable, as in this case the tube is likely to detach from the nipple.

In order to overcome this inconvenience, two possible solutions have been presented.

A first known solution is to enlarge the difference in radius between the nipple and the tube in order to enhance the sliding of the tube in or over the nipple.

Unfortunately this solution has the inconvenience that the connection between the nipple and the tube is not tight enough to prevent leakage.

Moreover such an adaptation of the radius of the tube and/or the nipple decreases the retention force of the nipple on the tube, resulting in an increased risk of the tube detaching from the nipple.

A second known solution for allowing a fluent assembly of the tube on or in the nipple is by providing a gliding agent on either the tube or the nipple.

An inconvenience of this solution is that the use of a gliding agent causes a severe reduction of the retention force between the tube and the nipple, allowing the tube to detach easily from said nipple.

Another inconvenience of this solution is that the gliding agent can dissolve in the product contained in said container, with a change of the composition of said product as a consequence.

It is clear that such a change of composition is not only highly unwanted in for example cosmetics, but may also be dangerous in the case of medical applications.

BRIEF SUMMARY OF THE INVENTION

The aim of the present invention is to provide a solution for one or several of the aforementioned and other inconveniences.

Thereto the present invention relates to a dispenser or vial pump, comprising a valve assembly and a tube that is fixed with one extremity to a nipple of said valve assembly, whereby said nipple and tube are in contact with each other with their respective contact surfaces and whereby at least one of said contact surfaces is provided with a roughness in order to decrease the friction between the nipple and the tube during assembly.

An advantage of the present invention is that, by providing a roughness on either one of said contact surfaces, the effective contact surface between the tube and the nipple is reduced, resulting in a reduction of the surface friction between said contact surfaces during assembly, which is favourable as it diminishes the risk that the tube upsets.

It should be noted that the roughness may have a maximum height or depth of 0.5 mm and preferably of less than 0.1 mm, this to be able to avoid leakage of a product through the connection between the tube and said nipple.

Furthermore, it is clear that such a roughness is not to be mistaken with teeth, as for example on hose liners, which have the purpose of retaining a tube on a nipple once the tube is slid over said teeth.

It is noticed that said roughness on the contact surface of the nipple and or of the tube, preferably results in a slight difference in form between the cross sections of both contact surfaces.

An advantage of such different form of cross section is that it implicates that both contact surfaces are not complementary to each other, so that the effective contact surface can be reduced.

According to a preferred embodiment, the roughness is directed in a general longitudinal direction.

Such a preferred embodiment has the advantage that the air, present in the roughness between the contact surfaces of the nipple and the tube can serve as a, so called air cushion, enhancing the sliding of the tube over the nipple.

Moreover, such a realisation of the roughness allows surplus air between both contact surfaces to escape easily.

The present invention also relates to a tube that can be applied in a dispenser or vial pump as described here above, which tube is provided with an inner or outer surface containing some roughness.

Finally the present invention concerns a vial assembly that can be applied in a dispenser or vial pump as described, which vial assembly contains a nipple that is provided with a roughness on its inner or outer surface.

DESCRIPTION OF THE DRAWINGS

In order to better explain the characteristics of the invention, the following preferred embodiments of a dispenser and a vial pump according to the invention, as well as of a tube used in such, are described as an example only without being limitative in any way, with reference to the accompanying drawings, in which:

FIG. 1 represents a dispenser 1 fixed on a rigid or flexible container 2 or the like, mainly consisting of a valve assembly 3 and of a tube 4 which is fixed with one extremity 5 to a tubular nipple 6 of said valve assembly 3 and which, with its other extremity extends towards the bottom in said container 2.

Figure 1:
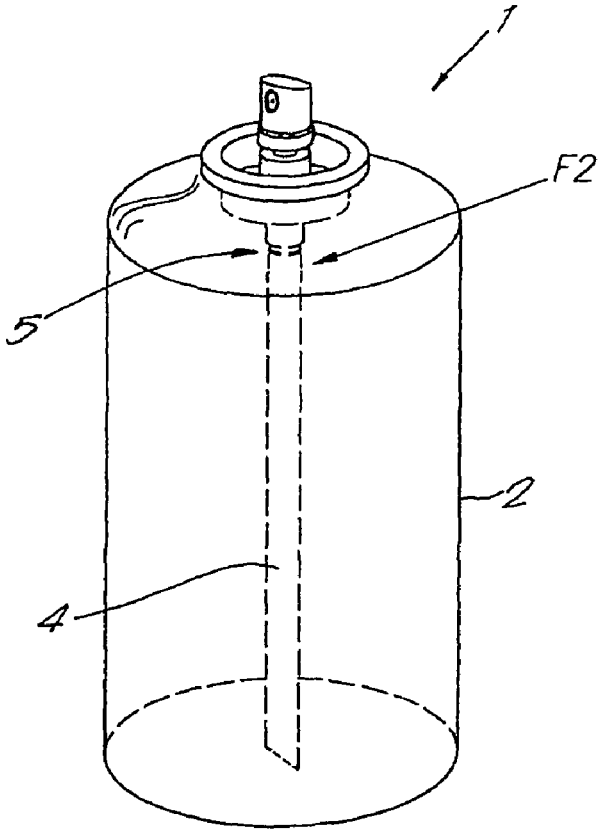
FIG. 1 represents a dispenser according to the invention fixed in a container.
Figure 2:
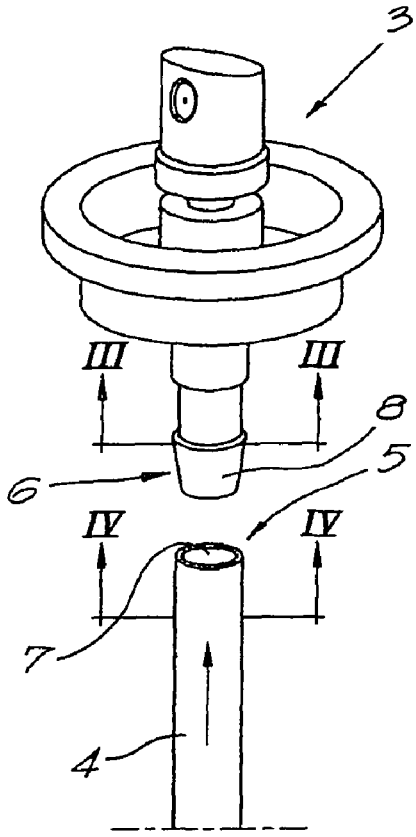
FIG. 2 represents on a larger scale an exploded view of the part F2 as indicated in FIG. 1.

In the example shown in FIG. 2, the tube 4 is slid over the nipple 6, whereby both elements are in contact with each other with their respective contact surfaces 7 and 8.

In this case, the contact surface 7 of the tube 4 is formed by the inner surface at said extremity 5 of this tube 4, whereas the contact surface 8 of the nipple 6 is formed by its outer surface.

Figure 3:
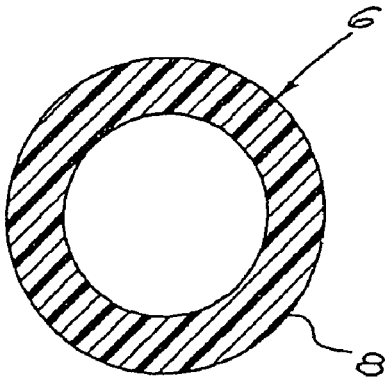
FIGS. 3 and 4 represent on a larger scale the cross sections indicated by line III-III, respectively line IV-IV in FIG. 2.
Figure 4:
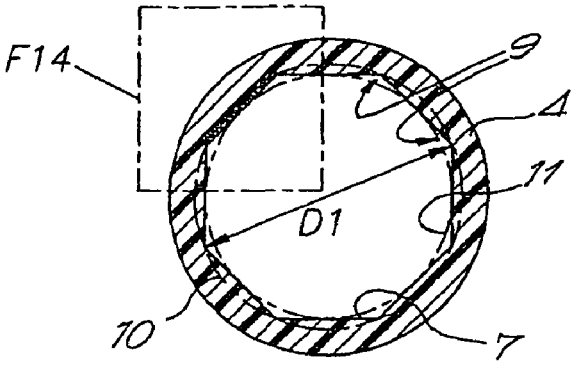

According to the present invention and as represented in FIGS. 3 and 4, at least one of said contact surfaces 7 and 8 is provided with a roughness 9, which, in this case, is realised by providing the tube 4 with a polygonal inner cross section, for example an octagonal inner cross section.

It is noted that said roughness 9 should not necessarily be realised as a polygonal inner cross section, but can be realised in different designs.

Furthermore, it is preferred to provide the roughness 9 in a general direction, parallel to the sliding direction of the tube 4 on the nipple 6, more particularly in a generally longitudinal direction.

As indicated with dotted lines in FIG. 4, said polygonal inner cross section can be defined in between a circumscribed circle 10 and an inner circle 1, whereby the difference in radii between both circles 10 and 1 is maximally 0.5 mm and preferably even less than 0.1 mm.

Furthermore it is preferred that the cross section of the nipple 6 has a maximum dimension that is equal or larger than the diameter D1 of said circumscribed circle 10 of the tube 4.

The assembly of the dispenser described here above is easy and as follows.

The tube 4 is fluently slid over said nipple 6 at a speed that may increase to more than 600 assemblies per minute, whereby said extremity 5 of the tube 4 grips over said nipple 6, allowing a sufficient strong fixation of the tube 4 on the valve assembly 3.

Since the contact surface 7 of the tube 4 is provided with a roughness 9, the surface over which there is an effective contact between the nipple 6 and the tube 4 is reduced in contradiction to a realisation whereby the contact surfaces 7 and 8 of the tube 4 and the nipple 6 are complementary.

This reduction of the effective contact surface results hereby in a reduction of the surface friction between the tube 4 and the nipple 6, thereby facilitating the sliding of the tube 4 over the nipple 6 and preventing the tube 4 of upsetting during assembly.

Also by providing the roughness 9 in a longitudinal direction, air, which is trapped in between the nipple 6 and the tube 4 during assembly, can more easily escape.

Figure 5:
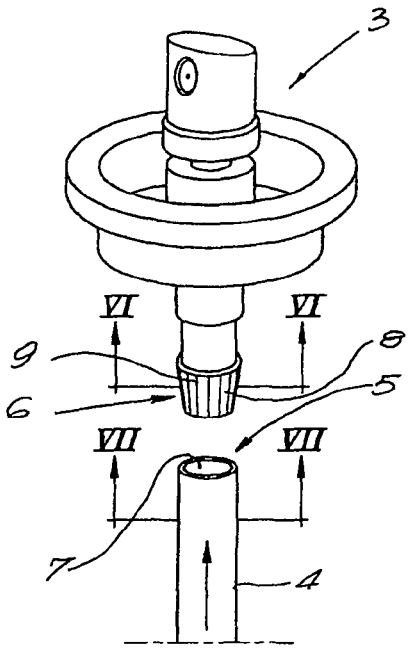
FIG. 5 represents a variant of FIG. 2.
Figure 6:
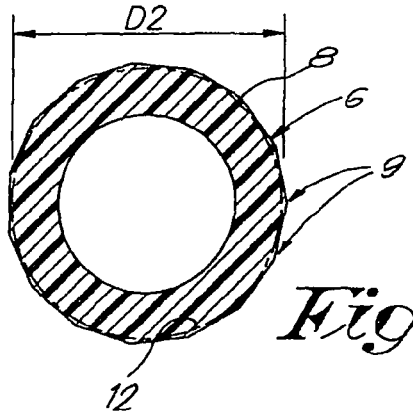
FIGS. 6 and 7 represent on a larger scale the cross sections indicated by line VI-VI, respectively line VII-VII in FIG. 5.
Figure 7:
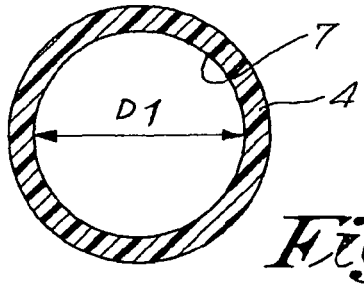
Figure 8:
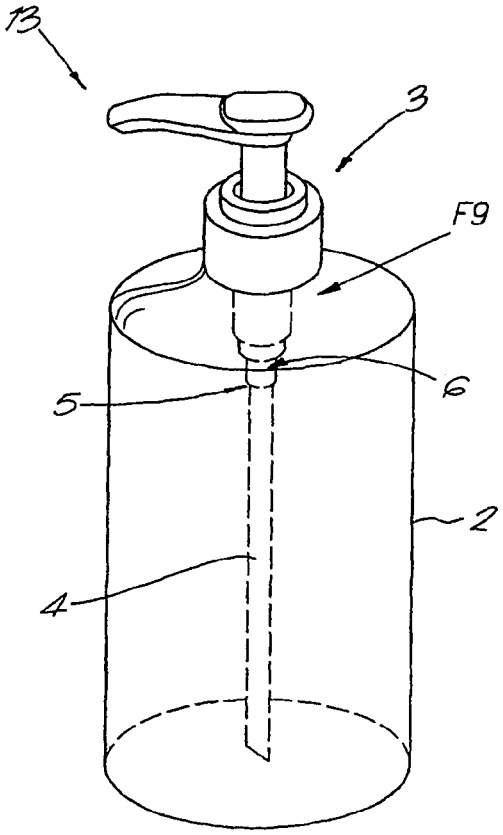
FIG. 8 represents a vial pump according to the invention fixed on a container.
Figure 9:
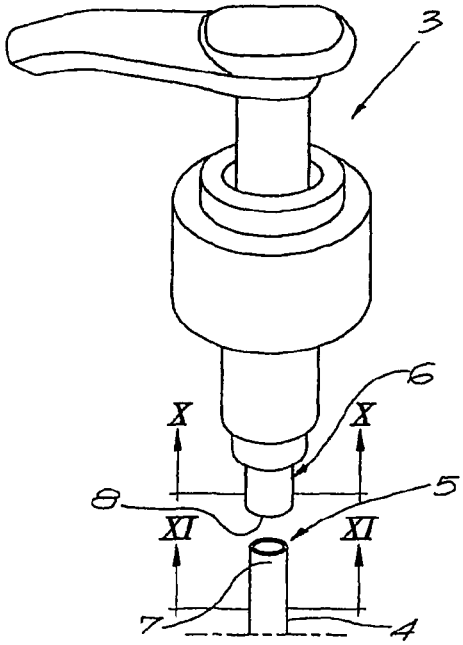
FIG. 9 represents on a larger scale an exploded view of the part F9 as indicated in FIG. 8.

FIGS. 5 to 7 represent a variant on the above described dispenser 1, whereby, in this case, the contact surface 8 of the nipple 6 is provided with a roughness 9, instead of the contact surface 7 of the tube 4, with the same result as mentioned here above.

In this case, it is preferred that an inner circle 12 describing the outer cross section of the nipple 6 has a diameter D2 as represented in FIG. 6 which is equal or larger than the diameter D1 of the inner cross section of the tube 4 as represented in FIG. 7.

FIGS. 8 to 13 represent a vial pump 13 comprising the same elements as said dispenser 1, but whereby said tube 4 is fixed into said nipple 6.

Figure 10:
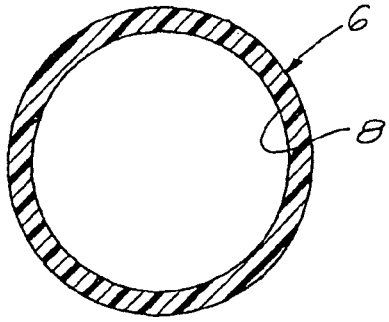
FIGS. 10, 11 and 12, 13 represent variants of respectively FIGS. 3, 4 and 6, 7.
Figure 11:
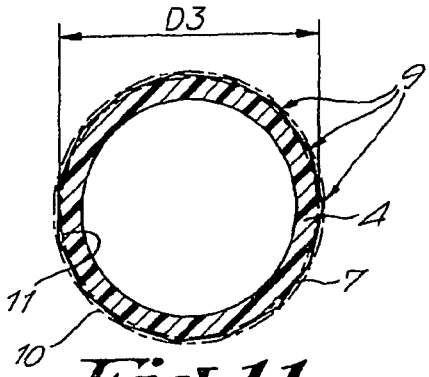
Figure 12:
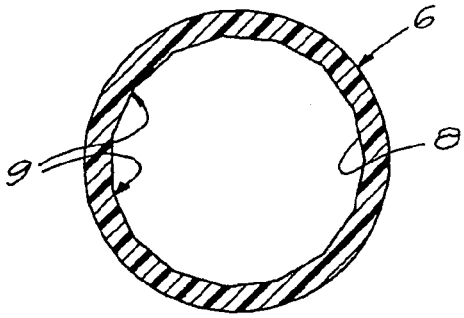
Figure 13:
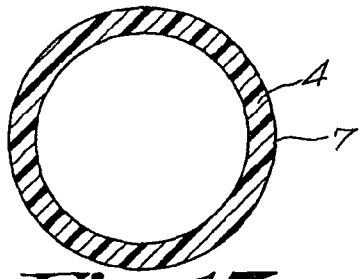
Figure 14:
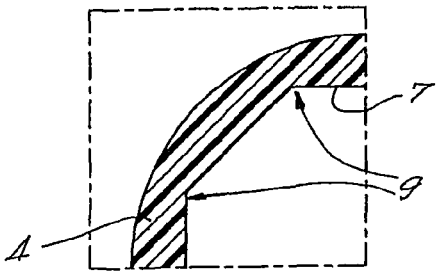
FIG. 14 represents more into detail the part F14, as indicated in FIG. 4.
Figure 15:
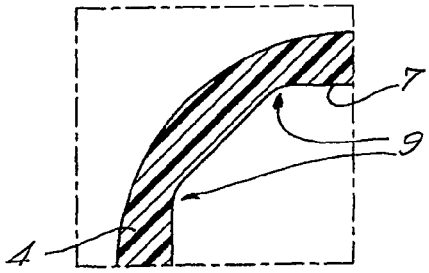
FIGS. 15 to 17 represent variants of FIG. 14.
Figure 16:
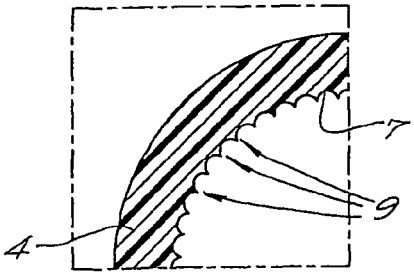
Figure 17:
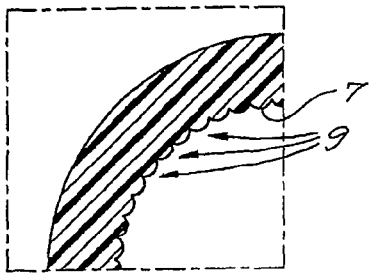

Said roughness on the contact surfaces 7 and 8 may then be situated at, respectively, the outer section of the tube 4 and/or the inner section of the nipple 6, as is represented in the FIGS. 10 and 11, respectively 12 and 13.

Hereby it is noted that whenever said roughness 9 is provided on the outer surface of the tube 4, said roughness 9 is defined within an inner circle 11 and a circumscribed circle 10, whereby the diameter D3 of the inner circle 11 is preferably equal or larger than the inner dimension of the nipple 6.

In FIGS. 14 to 17, variable designs of said roughness 9 are illustrated on a larger scale, whereby each roughness 9 is meant to limit the contact surface between said tube 4 and said nipple 6.

Examples of these designs are a contact surface with a polygonal cross section; a ribbed cross section; a cross section or a random form.

Although in the given examples the cross sections are always symmetrical forms, it should be noticed that it is not necessary to realise the roughness in such a form, since providing asymmetrical cross sections with a random form can also provide the desired effect of reducing the effective contact surface between the tube 4 and said nipple 6.

Concerning the tube 4 it is evident that said roughness 9 may extend over the entire length of said tube 4, but can also be limited to said extremity 5 of the tube 4.

Furthermore it is also possible to provide the roughness 9 on the contact surface 7 and 8, of both the tube 4 and the nipple 6, whereby care should be taken that both roughnesses 9 are not complementary to each other.

In order to avoid such complementary roughnesses 9, it is therefore preferable to provide both contact surfaces with a cross section that differs in form.

The present invention is by no means limited to the above described embodiments given as an example and represented in the accompanying drawings; on the contrary, such a dispenser or vial pump, as well as a tube applied therein, can be realised in all sorts of variants while still remaining within the scope of the present invention.

The invention claimed is:

1. Dispenser or vial pump, comprising a valve assembly, a nipple of the valve assembly, and a tube that is fixed at one extremity to the nipple, said nipple and tube comprising polyethylene or polypropylene materials and being in contact with each other at respective contact surfaces, wherein an outer surface of the tube is roughened over an entire length of the tube to provide a contact surface roughness that decreases friction between the nipple and the tube during assembly, the surface roughness comprising a symmetrical or nonsymmetrical cross section of a polygonal, ribbed or random form, and wherein said surface roughness comprises longitudinal ribs.

2. Dispenser or vial pump according to claim 1, wherein said surface roughness has a maximum height or depth of 0.5 mm.

3. Dispenser or vial pump according to claim 1, wherein said surface roughness has a maximum height or depth of 0.1 mm.

4. Dispenser or vial pump according to claim 1, wherein the contact surfaces of said tube and nipple have respective cross sections with different forms.

5. Dispenser or vial pump according to claim 1, wherein said surface roughness is provided by said contact surface having a polygonal cross section.

6. Dispenser or vial pump according to claim 5, wherein said polygonal cross section is an octagonal cross section.

7. Dispenser or vial pump, comprising a valve assembly, a nipple of the valve assembly, and a tube that is fixed at one extremity to the nipple, said nipple and tube comprising polyethylene or polypropylene materials and being in contact with each other at respective contact surfaces, wherein an outer surface of the tube is roughened over an entire length of the tube to provide a contact surface roughness that decreases friction between the nipple and the tube during assembly, the surface roughness comprising a symmetrical or nonsymmetrical cross section of a polygonal, ribbed or random form, and wherein said surface roughness is defined within an inner circle and a circumscribed circle, wherein the diameter of the inner circle is equal to or larger than the inner dimension of the nipple.

8. Dispenser or vial pump, comprising a valve assembly, a nipple of the valve assembly, and a tube that is fixed at one extremity to the nipple, said nipple and tube comprising polyethylene or polypropylene materials and being in contact with each other at respective contact surfaces, wherein an outer surface of the tube is roughened over an entire length of the tube to provide a contact surface roughness that decreases friction between the nipple and the tube during assembly, the surface roughness comprising a symmetrical or nonsymmetrical cross section of a polygonal, ribbed or random form, and wherein said nipple has a roughness on its inner surface.

9. Dispenser or vial pump, comprising a valve assembly, a nipple of the valve assembly, and a tube that is fixed at one extremity to the nipple, said nipple and tube comprising polyethylene or polypropylene materials and being in contact with each other at respective contact surfaces, wherein an outer contact surface of the tube is roughened to provide a surface roughness that decreases friction between the nipple and the tube during assembly, the surface roughness comprising a symmetrical or nonsymmetrical cross section of a polygonal, ribbed or random form, and wherein said surface roughness of the tube is defined within an inner circle and a circumscribed circle, and the diameter of the inner circle is equal to or larger than the inner dimension of the nipple.

10. Dispenser or vial pump, comprising a valve assembly, a nipple of the valve assembly, and a tube that is fixed at one extremity to the nipple, said nipple and tube comprising polyethylene or polypropylene materials and being in contact with each other at respective contact surfaces, wherein an outer contact surface of the tube is roughened to provide a surface roughness that decreases friction between the nipple and the tube during assembly, the surface roughness comprising a symmetrical or nonsymmetrical cross section of a polygonal, ribbed or random form, and wherein said surface roughness comprises longitudinal ribs.

11. Dispenser or vial pump, comprising a valve assembly, a nipple of the valve assembly, and a tube that is fixed at one extremity to the nipple, said nipple and tube comprising polyethylene or polypropylene materials and being in contact with each other at respective contact surfaces, wherein an outer contact surface of the tube is roughened to provide a surface roughness that decreases friction between the nipple and the tube during assembly, the surface roughness comprising a symmetrical or nonsymmetrical cross section of a polygonal, ribbed or random form, and wherein said nipple has a roughness on its inner surface.

* * * * *

UNITED STATES PATENT AND TRADEMARK OFFICE

CERTIFICATE OF CORRECTION

PATENT NO. : 8,074,846 B2
APPLICATION NO. : 11/659963
DATED : December 13, 2011
INVENTOR(S) : Allegaert It is certified that error appears in the above-identified patent and that said Letters Patent is hereby corrected as shown below:

On the Title page, item [73]

delete "Tekni-Plex, Inc." and insert -- Tekni-Plex Europe, Naamloze Vennootschap --

Signed and Sealed this
Second Day of December, 2014

Michelle K. Lee

Michelle K. Lee
*Deputy Director of the United States Patent and Trademark Office*